US008517680B1

(12) United States Patent
Liang

(10) Patent No.: US 8,517,680 B1
(45) Date of Patent: Aug. 27, 2013

(54) TURBINE BLADE WITH PLATFORM COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 565 days.

(21) Appl. No.: 12/766,240

(22) Filed: Apr. 23, 2010

(51) Int. Cl.
*F01D 25/12* (2006.01)

(52) U.S. Cl.
USPC ..... 416/1; 416/97 R; 416/193 A

(58) Field of Classification Search
USPC ..... 415/115, 116; 416/1, 96 R, 97 R, 416/193 A
See application file for complete search history.

(56) References Cited

U.S. PATENT DOCUMENTS 5,344,283 A * 9/1994 Magowan et al. ..... 415/115
5,813,835 A * 9/1998 Corsmeier et al. ..... 416/97 R
6,017,189 A * 1/2000 Judet et al. ..... 416/97 R
6,019,579 A * 2/2000 Fukuno et al. ..... 416/97 R
6,120,249 A * 9/2000 Hultgren et al. ..... 416/97 R
6,254,333 B1 * 7/2001 Merry ..... 415/115
6,261,053 B1 * 7/2001 Anderson et al. ..... 415/115
7,255,536 B2 * 8/2007 Cunha et al. ..... 416/97 R
7,686,581 B2 * 3/2010 Brittingham et al. ..... 416/97 R
7,695,247 B1 * 4/2010 Liang ..... 416/97 R
2009/0232660 A1 * 9/2009 Liang ..... 416/97 R

* cited by examiner

*Primary Examiner* — Edward Look
*Assistant Examiner* — Liam McDowell
(74) *Attorney, Agent, or Firm* — John Ryznic

(57) ABSTRACT

A turbine rotor blade with a platform cooling circuit that includes three zones with one zone occupying the entire pressure side of the platform and two zones occupying the entire suction side of the platform. Each zone is formed with a series of impingement ribs that form separated impingement chambers with impingement holes formed in the ribs to form a series of impingement holes with impingement chambers along the entire platform. Each zone is supplied with cooling air from one or more cooling air supply holes located in the forward most impingement chamber. The three zones discharge cooling air out through exit holes located along the two mate-faces and the aft side of the platform so that the cooling air discharged does not overlap.

13 Claims, 2 Drawing Sheets

View A-A prior art

View B-B

TURBINE BLADE WITH PLATFORM COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to gas turbine engine, and more specifically a turbine rotor blade with platform cooling.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

Turbine rotor blades have a platform that forms a flow path for a hot gas stream and thus must also be cooled in order to prevent hot spots that lead to erosion or other damage to the blade. FIG. 1 shows one prior art blade 10 platform cooling design in which the platform includes a pressure side (P/S) and a suction side (S/S) with each having a series of straight cooling channels formed within the platform to provide cooling. The P/S platform includes three straight large channels 12 that discharge on the aft side of the platform. The S/S platform includes one large straight channel 12 that feeds into three smaller straight channels 13 that also discharge out the aft side of the platform. For each of these straight channels 12, a row of cooling air inlet holes are arranged on the forward end of the platform and connect to a dead rim cavity located below the platform for a supply of cooling air. FIG. 2 shows a cross section view through the line A-A in FIG. 1 with the airfoil extending from the platform 11 and three of the straight cooling channels 12 on the P/S platform.

In the prior art blade platform cooling design of FIG. 1, for an airfoil with a low cooling flow design, especially a low platform cooling flow design, better cooling of the platform would require adding more of the straight cooling channels by making them closer together. Using more of these straight cooling channels would require more cooling flow in the platform. Without better cooling of the platform, hot spots will occur in-between the straight cooling channels and produce uneven cooling for the platform surface.

BRIEF SUMMARY OF THE INVENTION

An air cooled turbine rotor blade with a platform having a row of cooling air inlet holes located in the forward side of the platform to supply cooling air to a platform cooling circuit that includes a multiple impingement cooling circuit over the entire platform surface from the forward side to the aft side of the platform. The multiple impingement cooling circuit is formed as three zones with each zone connected to at least one cooling supply hole, and each zone having a series of impingement holes that discharge into an impingement chamber before discharging the cooling air out through exit holes arranged along the side of the platform in that zone.

Each zone includes rows of impingement ribs that separate a series of impingement cavities, where the impingement ribs each include a series of impingement holes. The impingement holes on adjacent ribs are offset so that the impingement holes of one rib will discharge impingement air against the downstream rib away from the impingement holes. With this design, the width of the impingement cooling channels can be increased to cover the entire platform surface without requiring more cooling air flow.

DETAILED DESCRIPTION OF THE INVENTION

Figure 1:
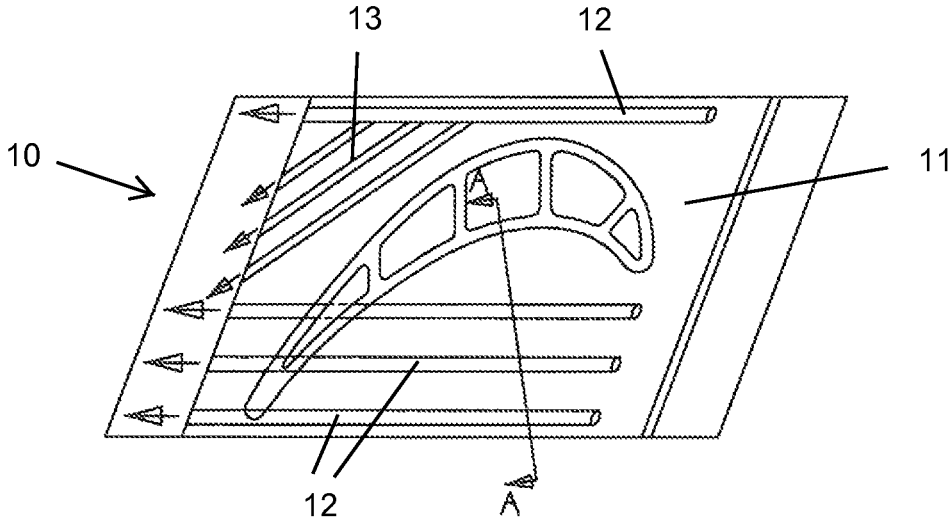
Fig 1 prior art
FIG. 1 shows a cross section view from the top of a prior art turbine blade with platform cooling channels on both sides of the airfoil.
Figure 2:
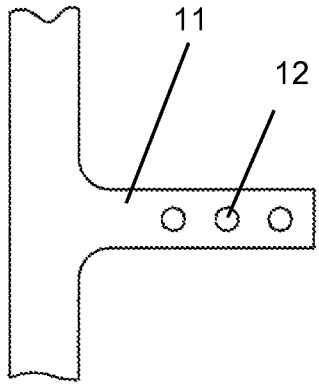
FIG. 2 shows a cross section side view of the pressure side platform cooling channels through the line A-A in FIG. 1.
Figure 3:
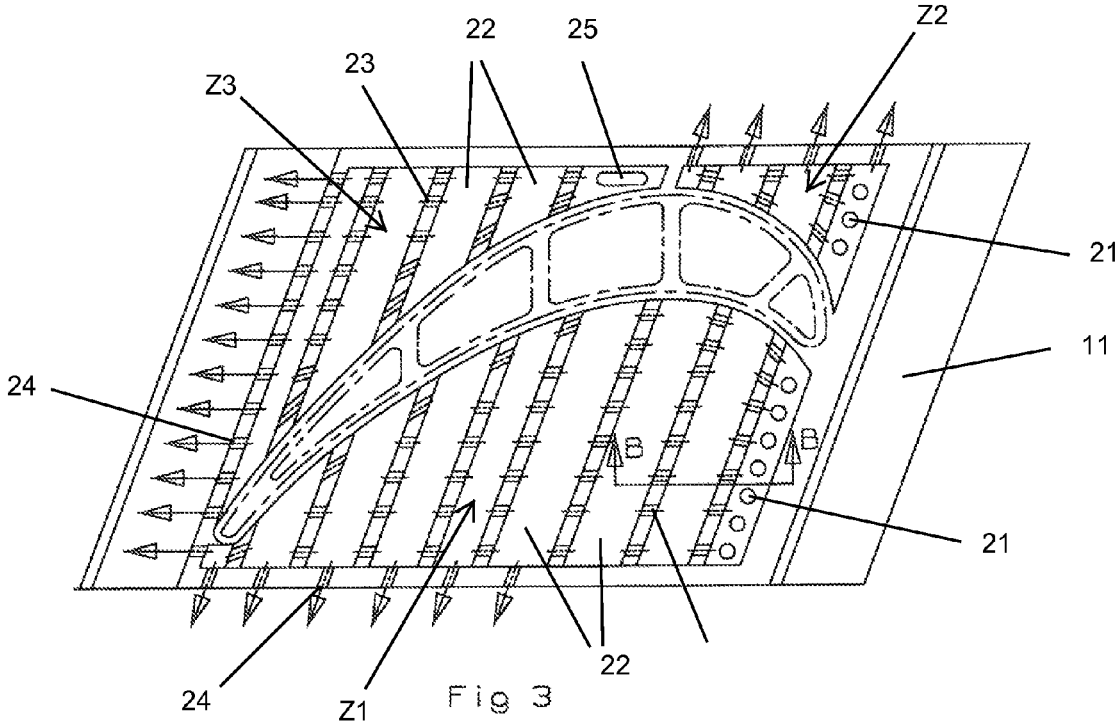
FIG. 3 shows a cross section top view of the rotor blade platform cooling circuit of the present invention.

A turbine blade for a gas turbine engine, especially for an industrial gas turbine engine of the frame type heavy duty engine, with an airfoil extending from a platform. FIG. 3 shows the blade and platform with the platform cooling circuit separated into three zones or compartments each separated from one another within the platform. In this embodiment, the platform is divided up into a pressure side zone Z1 and two suction side zones that include a forward suction side zone Z2 and an aft suction side zone Z3.

A row of cooling air supply holes 21 is arranged along the forward side of the platform and is connected to a dead rim cavity formed below the platform to supply cooling air to the platform cooling circuit. A row of cooling supply holes is connected to the P/S zone Z1 and another row is connected to the S/S zone Z2. Each of the platform cooling zones includes a number of rows of impingement ribs that are generally parallel to the forward and aft sides of the platform and extend along the entire platform as seen in FIG. 3. Each of the impingement ribs extends from the side of the platform to the airfoil to form separated impingement chambers 22. Each of the impingement ribs include a row of impingement holes 23 with adjacent ribs having the impingement holes offset so that one impingement hole does not discharge directly toward another impingement hole but discharges against the impingement rib to produce impingement cooling.

The two zones of the S/S are separated by a rib without an impingement hole, the rib being located at the location where the platform side is closest to the airfoil surface. The aft S/S zone Z3 is connected to a single cooling supply hole 25 that is also connected to the dead rim cavity formed below the platform. The cooling supply hole 25 for the third zone Z3 is a larger cooling supply hole than the smaller holes 21 becomes of the limited space between the airfoil and the mate-face side of the platform. The hole 25 is a stretched oval with the longer side being parallel to the mate-face.

Each of the three zones is connected to a row of cooling air exit holes 24 arranged along the side of the platform that forms the mate-face or side gap in the area of that particular zone to discharge the spent impingement cooling air from the zone. The zone Z1 discharges cooling air to cool the gap between adjacent blade platforms along the space shown in FIG. 3, while the zone Z2 will discharge the cooling air along the mate-face gap and the platform sides formed between adjacent blade platforms for the remaining space. Thus, the zones Z1 and Z2 have exit cooling holes along the mate-faces that will not overlap such that cooling air from exit holes on zone Z1 will flow into the gap space where cooling air from an exit hole along zone Z2 does not flow. Thus, since no overlapping occurs, no duplication of mate-face gap cooling air will occur. Because adjacent blades include the same platform cooling circuit, all of the sides of the platforms will be cooled with cooling air discharged from the exit holes. The exit holes for the zone Z3 extends along substantially the entire aft side of the platform and will provide cooling for the adjacent platform on its forward side. One exit cooling hole from the first zone Z1 is connected along the aft side of the platform to join the row of exit holes from zone Z3 to discharge along the aft side of the platform. This is because the trailing edge of the airfoil is too close to the platform aft side to allow for the zone Z3 exit holes to extend along the entire aft side of the platform. Thus, the last impingement chamber along the first zone Z1 will discharge through exit holes along both the pressure side mate-face and the aft side of the platform. The cooling air discharged from the zone Z3 will flow into the gap formed between an adjacent stator vane of other stationary seal face.

Figure 4:
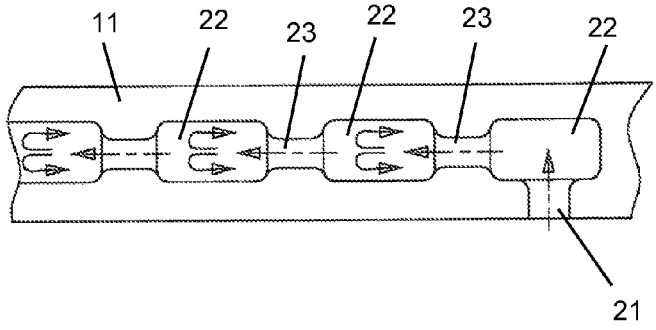
FIG. 4 shows a cross section side view through the line B-B in FIG. 3 showing a series of impingement cooling chambers.

FIG. 4 shows a cross section side view of the multiple impingement cooling circuit of FIG. 3. The cooling air supply hole 21 is connected to the dead rim cavity formed below the platform 11 and discharges cooling air into the first impingement chamber 22 to provide backside impingement cooling to the top surface of the platform above this chamber 22. The cooling air then flows through the first impingement hole 23 and then into the second impingement chamber 22 to provide impingement cooling in that chamber. The cooling air continues to flow through impingement hole 23 followed by impingement chamber 22 until the last impingement chamber, where the cooling air then flows out through the row of exit holes 24 in that particular zone.

As the cooling air flows through the impingement holes and is impinged onto the rib, the cooling air forms a pair of vortices within the chamber that also produces backside wall cooling of the platform wall above the chambers. The pair of vortices will generate a side wall impingement heat transfer effect. The separate zones in the streamwise direction of the platform will allow for tailoring of the platform cooling for local gas side pressure distribution and heat load. The spent cooling air from each impingement zone is discharged at the platform mate face for the cooling and purging of the blade platform gap.

Major advantages of the multiple impingement platform cooling circuit of the present invention are described below. Individual impingement cooling cavities can be designed based on the airfoil local heat load and streamwise pressure profile. This results in a more effective use of the cooling air and provides for a more uniform platform metal temperature. Multiple impingement with multiple compartments or zones will utilize the same amount of cooling air but yield a higher level of backside impingement heat transfer coefficient and a cooler airfoil metal temperature than the prior art platform with multiple straight cooling channels. In the prior art platform suction side channel cooling design with cooling supply channel, the supply channels bleeds off cooling air which then reduces the channel flow cooling potential near the platform mate-face. With the multiple impingement cooling design of the present invention, the same amount of cooling flow occurs in each of the impingement chambers along the entire platform surface and therefore provides a higher heat transfer coefficient than the prior art design. Multiple use of the cooling air provides for a higher overall cooling effectiveness level. The single row of impingement jet cooling for the multiple impingement cooling cavities eliminates any cross flow effect on impingement and therefore achieves a much higher impingement heat transfer level for a given flow rate. The cooling air is used for the blade platform cooling first and then used for the mate-face cooling and purge air.

I claim the following:

1. An air cooled turbine rotor blade comprising:

an airfoil section extending from a platform;

the platform having a forward side and an aft side;

the platform having a pressure side and a suction side that both form a mate-face gap with an adjacent turbine rotor blade platform;

a first platform cooling zone formed on a pressure side of the platform;

a second platform cooling zone formed on a forward end of the suction side of the platform;

a third platform cooling zone formed on an aft end of the suction side of the platform;

the three platform cooling zones each being formed with a series of ribs that form a series of impingement chambers, and with each rib including a row of impingement holes; and, a cooling air supply hole connected to each of the three platform cooling zones at a forward location of each of the three platform cooling zones to supply cooling air from a dead rim cavity to each of the three platform cooling zones.

2. The air cooled turbine rotor blade of claim 1, and further comprising:

a separation between the second zone and the third zone on the suction side is near to a location where the airfoil surface is closest to the platform mate-face gap.

3. The air cooled turbine rotor blade of claim 1, and further comprising:

the first and second zones are each connected to a row of cooling air supply holes; and, the third zone is connected to just one cooling air supply hole.

4. The air cooled turbine rotor blade of claim 1, and further comprising:

the ribs extend from the mate-face gap side to the airfoil along an entire platform surface.

5. The air cooled turbine rotor blade of claim 1, and further comprising:

the first zone is connected to a first row of exit cooling holes on the pressure side mate-face;

the second zone is connected to a second row of exit cooling holes on the suction side mate-face; and, the first and second rows of mate-face exit cooling holes do not overlap for adjacent blade platforms.

6. The air cooled turbine rotor blade of claim 1, and further comprising:

the third zone is connected to a first row of exit cooling holes on an aft side of the platform and extends along substantially an entire aft side of the platform.

7. The air cooled turbine rotor blade of claim 1, and further comprising:

impingement holes in adjacent ribs are offset so that an upstream impingement hole does not line up with a downstream impingement hole.

8. A process for cooling a platform of a turbine rotor blade comprising the steps of:

passing cooling air from a dead rim cavity through impingement holes along a forward side of the platform to provide impingement cooling to a forward side section of the platform;

passing the impingement cooling air through a series of impingement cooling holes and impingement chambers formed along a pressure side and a suction side of the platform, the impingement chamber being formed from a series of ribs with each of the ribs including a row of the impingement cooling holes;

discharging the impingement cooling air from the pressure side of the platform along a pressure side mate face along an aft region of the mate-face; and, discharging the impingement cooling air along the suction side of the platform along the suction side mate face along a forward region of the pressure side mate-face so that the pressure side mate-face discharging cooling air does not overlap with the suction side mate-face discharging cooling air.

9. The process for cooling a platform of claim 8, and further comprising the steps of:

the step of passing cooling air along the suction side of the platform includes passing cooling air along a forward region of the suction side of the platform with a first cooling air flow; and, passing cooling air along an aft region of the suction side of the platform with a second cooling air flow separate from the first cooling air flow.

10. The process for cooling a platform of claim 9, and further comprising the step of:

discharging the second cooling air flow along an aft side of the platform.

11. A process for cooling a platform of a turbine rotor blade comprising the steps of:

passing a first cooling air flow from a dead rim cavity formed below the platform into a first impingement channel formed in a forward section of a pressure side of the platform;

passing the first cooling air flow through a series of impingement cooling holes and impingement chambers to cool the pressure side of the platform, the impingement chamber being formed from a series of ribs with each of the ribs including a row of the impingement cooling holes;

passing a second cooling air flow from the dead rim cavity into a second impingement cooling channel formed in a forward section of a suction side of the platform;

passing the second cooling air flow through a series of impingement cooling holes and impingement chambers to cool a forward section of the suction side of the platform;

passing a third cooling air flow from the dead rim cavity into a third impingement cooling channel formed in an aft section of a suction side of the platform;

passing the third cooling air flow through a series of impingement cooling holes and impingement chambers to cool an aft section of the suction side of the platform;

discharging the first cooling air flow along an aft side of a pressure side mate face of the platform;

discharging the second cooling air flow along a forward side of a suction side mate face of the platform; and, discharging the third cooling air flow along an entire aft side of the platform.

12. The process for cooling a platform of a turbine rotor blade of claim 11, and further comprising the steps of:

passing the first cooling air flow, the second cooling air flow and the third cooling air flow through separate cooling circuits formed within the platform.

13. The process for cooling a platform of a turbine rotor blade of claim 11, and further comprising the steps of:

passing the first cooling air flow, the second cooling air flow and the third cooling air flow through the platform without passing through an airfoil of the blade.

* * * * *